United States Patent [19]

Gilbert

[11] 4,348,163

[45] Sep. 7, 1982

[54] FUEL INJECTION PUMP LIMIT MECHANISM

[75] Inventor: Wesley B. Gilbert, Windsor, Conn.

[73] Assignee: Standadyne, Inc., Hartford, Conn.

[21] Appl. No.: 177,277

[22] Filed: Aug. 11, 1980

[51] Int. Cl.[3] ..... F04B 29/00
[52] U.S. Cl. ..... 417/462
[58] Field of Search ..... 417/460, 462, DIG. 1

[56] References Cited

U.S. PATENT DOCUMENTS

| | | | |
|---|---|---|---|
| 3,002,464 | 10/1961 | Lee | 417/DIG. 1 |
| 3,044,687 | 7/1962 | Davey | 417/DIG. 1 |
| 4,098,249 | 7/1978 | Mowbray | 417/462 |

*Primary Examiner*—William L. Freeh
*Attorney, Agent, or Firm*—Prutzman, Kalb, Chilton & Alix

[57] ABSTRACT

A rotary fuel injection pump with a charge pump piston limit mechanism having wear compensation means for maintaining the predetermined stroke limit setting of the charge pump pistons.

9 Claims, 6 Drawing Figures

FUEL INJECTION PUMP LIMIT MECHANISM

TECHNICAL FIELD

The present invention relates generally to fuel injection pumps of the type having a rotary charge pump with diametrically opposed reciprocating pumping plungers for supplying sequential charges of fuel under high pressure to the fuel injection nozzles of an associated internal combustion engine and relates more particularly to a new and improved mechanism for limiting the outward intake stroke of the pumping plungers and thereby limit the amount of fuel supplied during the inward compression stroke of the plungers.

BACKGROUND AND DISCLOSURE OF INVENTION

In fuel injection pumps of the type having reciprocating pumping plungers, the fuel charge which can be delivered by the pump is frequently controlled by limiting the outward fuel intake stroke of the pumping plungers to provide a relatively large fuel charge during starting and a lower fuel charge limit during normal engine operation which avoids incomplete combustion and resulting pollution. A plunger stroke limit mechanism providing such fuel charge control is disclosed in the pending U.S. application Ser. No. 859,847, now U.S. Pat. No. 4,225,291 of the common assignee hereof, of Gerald R. Bouwkamp, filed Dec. 12, 1977, and entitled "Fuel Injection Pump and Plunger Control Means Therefor". However, it has been found that normal wear of the parts of such a mechanism will result in an undesirable increase in the plunger intake stroke limit to permit excess fuel and resulting incomplete and inefficient combustion and pollution during full load engine operation.

It is, therefore, a principal object of the present invention to provide a new and improved fuel injection pump stroke limit mechanism of the type described in U.S. application Ser. No. 859,847 for establishing a plunger intake stroke limit which will not substantially increase during an extended operating period of the pump.

It is another object of the present invention to provide a new and improved fuel injection pump stroke limit mechanism of the type described which provides automatic wear compensation for preventing wear from causing increase in the plunger stroke limit.

It is still another object of the present invention to provide an improved stroke limit mechanism of the type described for setting a predetermined plunger stroke limit which remains within a close tolerance over a substantial useful operating period of the pump.

A still further object of the present invention is to provide a new and improved plunger stroke limit mechanism which can be economically fabricated and assembled and which will operate effectively over a long period of use without adjustment.

Other objects will be in part obvious and in part pointed out more in detail hereinafter.

A better understanding of the invention will be obtained from the following detailed description and the accompanying drawings.

BEST MODES FOR CARRYING OUT THE INVENTION

Figure 1:
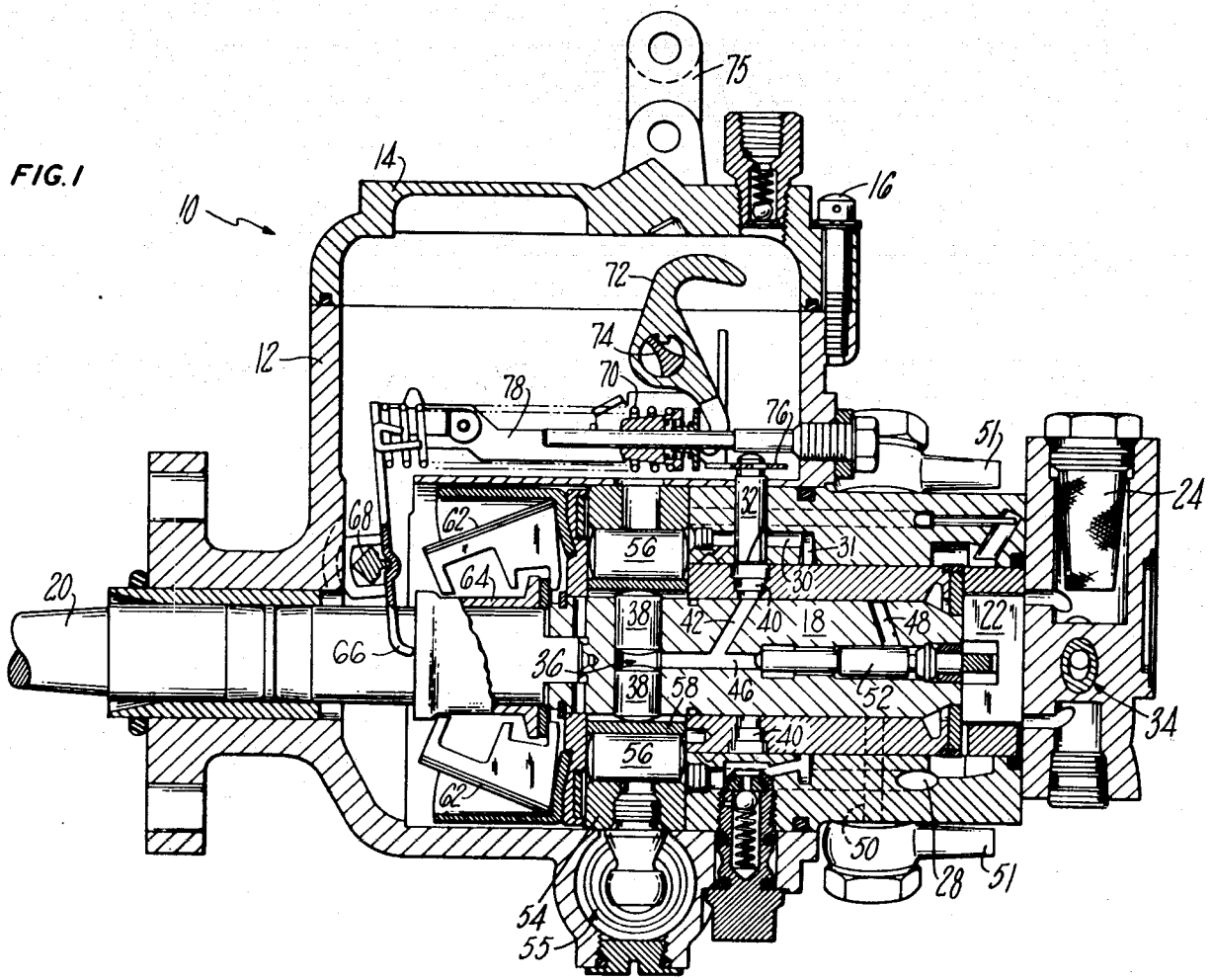
FIG. 1 is a longitudinal section view, partly broken away and partly in section, of a fuel injection pump suitable for the practice of the present invention.

Referring now to the drawings in detail, wherein like numerals represent like parts, there is shown a fuel injection pump 10 like the fuel injection pump shown and described in the aforementioned U.S. patent application Ser. No. 859,847. The fuel pump 10 is adapted to supply measured pulses or charges of fuel to the several fuel injection nozzles (not shown) of an internal combustion engine (not shown). A pump housing 12 having a cover 14 secured by fasteners 16, rotatably supports a pump rotor 18 having a drive shaft 20 with a tapered end for receiving a drive gear (not shown) for driving the pump in synchronism with the associated internal combustion engine.

A vane-type transfer or low pressure supply pump 22 driven by the rotor 18 receives fuel via a fuel inlet 24 from a suitable fuel reservoir (not shown) and delivers fuel under pressure via an axial bore 28, an annulus 31 and an axial bore 30 to a fuel inlet metering valve 32. A transfer pressure regulating valve 34 regulates the output pressure of the transfer pump 22 and returns excess fuel to the transfer pump inlet 24.

A high pressure charge pump 36 driven by the rotor 18 comprises a pair of opposed plungers 38 reciprocable in a diametral bore of the rotor 18. The charge pump 36 receives metered fuel from the metering valve 32 through an annular arrangement of a plurality of angularly spaced radial passages 40 adapted for sequential registration with an inlet passage 42 of the rotor 18 as it rotates. Fuel under high pressure is delivered by the charge pump 36 through an axial bore 46 in the rotor 18 to a rotary distributor having a fuel delivery bore or passage 48. The fuel delivery bore 48 is located for sequential registration with a plurality of angularly spaced distributor outlet passages 50 which communicate with respective individual fuel injection nozzles (not shown) via fuel line connectors 51 spaced around the peripery of the housing 12. A positive displacement fuel delivery valve 52 mounted in the axial bore 46 is provided for achieving a sharp cut-off of fuel to the nozzles and thereby eliminate fuel dribble into the engine combustion chamber after normal fuel injection.

The angularly spaced radial inlet passages 40 to the charge pump 36 and the angularly spaced outlet passages 50 of the rotary distributor are located to provide registration respectively with the charge pump inlet passage 42 during the outward intake stroke of the plungers 38 and with the fuel delivery passage 48 during the inward compression stroke of the plungers 38.

An annular cam 54 having a plurality of pairs of diametrically opposed camming lobes is provided for actuating the charge pump plungers 38 inwardly together for periodically delivering pulses of pressurized fuel to the fuel injection nozzles for injection of fuel charges into the engine cylinders. A roller 56 and roller shoe 58 are mounted in radial alignment with each plunger 38 for camming the plungers inwardly with the annular cam 54. For timing the distribution of the fuel pulses to the fuel nozzles in proper synchronism with the operation of the associated engine, the annular cam 54 is adapted to be angularly adjusted by a suitable charge timing mechanism 55.

A plurality of governor weights 62, angularly spaced about the pump shaft 20, provide a variable governing bias on a sleeve 64 which engages a governor plate 66 to urge it clockwise as viewed in FIG. 1 about a support pivot 68. The governor plate 66 is urged in the opposite pivotal direction by a compression spring 70 having a bias which is adjustable by a lever 72 operated by a throttle arm 75 on a throttle shaft 74. The governor plate 66 is connected for controlling the angular position of the metering valve 32 by a control arm 76 on the metering valve and a link 78 pivotally connected to the control arm 76 and normally biased by a tension spring (not shown) into engagement with the governor plate 66.

As is well known, the quantity or measure of the charge of fuel delivered by the charge pump 36 is readily controlled by varying the inlet fuel restriction with the metering valve 32. The pump governor controls the angular position of the metering valve 32 to maintain the engine speed under varying engine load conditions at the speed established by the throttle shaft 74. Rotation of the metering valve 32 under the control of the pump governor varies the metering valve restriction between the passages 30 and 40 and thereby varies the fuel delivered to the charge pump during the outward radial intake stroke of the plungers 38 and consequently the fuel charge delivered to the associated engine during the inward compression stroke of the plungers 38.

As indicated, the amount of the injected fuel charge is normally determined by the setting of the metering valve 32. In addition, the maximum available fuel charge is established by a plunger stroke limit mechanism, generally designated by the numeral 80, having a pair of limit arms 84 (FIG. 2) mounted on the rotor 18 by respective adjustment screws 86. The adjustment screws 86 are formed with spherical seats 87, and the limit arms 84 are formed with mating spherical sockets 89 for pivotal movement of the limit arms 84 on the screws 86. One end 88 of each limit arm 84 overlies the outer end of one of the plunger shoes 58 to limit its outward radial movement and hence limit the maximum outward intake stroke of the respective pumping plunger 38 and the maximum quantity of fuel delivered to and by the charge pump. The limit arms 84 are individually adjusted by their respective adjusting screws 86 to set the outer limit or maximum stroke of the pumping plungers 38. Also, the ends 88 of the limit arms 84 which overlie the shoes 58 can be made slightly longer than the other ends 115 so that the centrifugal force will maintain the plunger shoe ends 88 outwardly to minimize their engagement interval with the shoes 58 during each charge pump cycle and, thereby minimize the wear caused by such engagement.

An actuator mechanism 90 for the limit arms 84 is provided for controlling the maximum fuel charge of the pump under different operating conditions, and more specifically to provide a larger maximum available fuel charge during engine cranking than during normal engine operation. Therefore, the intake stroke limit arms 84 of the pumping plungers are positioned by the actuator mechanism 90 to provide a longer maximum plunger stroke during engine cranking and to reduce the maximum plunger stroke at a predetermined speed just above cranking speed.

An axial bore 96 in the rotor 18 is connected to the transfer pump 22 to conduct fuel under transfer pressure for hydraulically actuating a control piston 98 of the actuator mechanism 90 and such that transfer pressure urges the piston 98 outwardly. The piston 98 is slidably mounted in a radial bore 100 in the rotor 18 and is retained in the radial bore 100 by a fixed limit pin 102. The limit pin 102 is secured within aligned axially extending bores (not shown) in the rotor 18 on opposite sides of the radial bore 100, and the piston 98 has a transverse circular opening 104 for receiving the pin 102 and which is enlarged to permit the piston 98 to move a predetermined limited amount in the radial bore 100.

A compression spring 106 is mounted between the fixed limit pin 102 and an inner end wall 108 of the cup-shaped piston 98 to bias the piston inwardly. Also, the inner end wall 108 of the piston 98 has a central section 110 which provides a recessed spring seat for a check valve closure spring 112 of a ball check valve 114.

Figure 2:
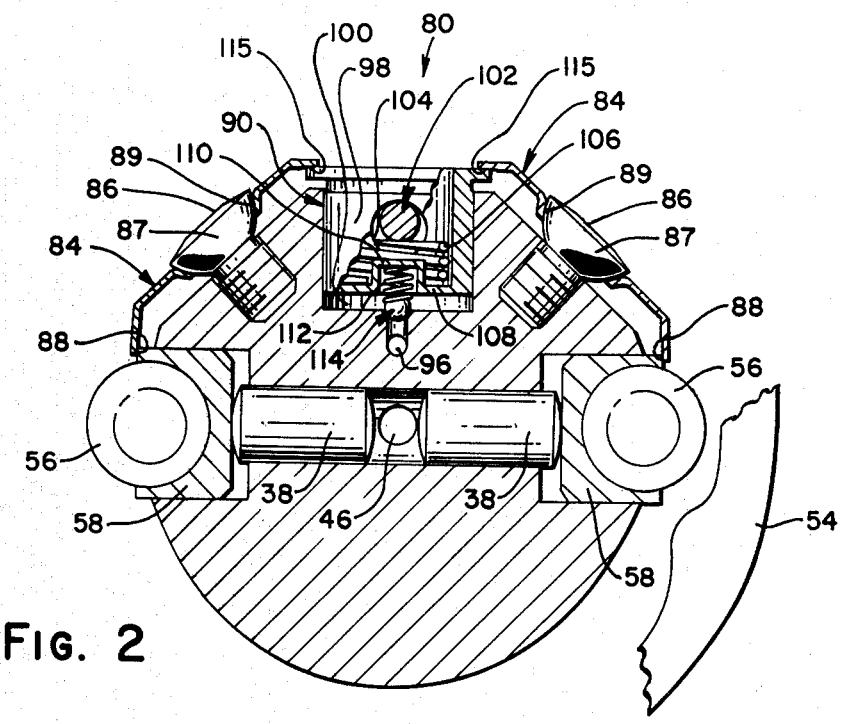
FIG. 2 is an enlarged fragmentary transverse section view, partly broken away and partly in section, of a charge pump of the fuel injection pump, showing a stroke limit mechanism incorporating an embodiment of the present invention.

The pair of limit arms 84 have respective ends 115 which overlie and engage a flange on the outer end of the piston 98. At relatively low engine cranking speed, the force of the compression spring 106 is sufficient to maintain the piston 98 at its inward limit position in engagement with the limit pin 102 as shown in FIG. 2 in opposition to centrifugal force and the transfer fuel pressure in the piston bore 100. Accordingly, the limit arms 84 allow the roller shoes 58 to move outwardly a maximum amount to supply a maximum fuel charge for engine starting. After the engine starts and the engine speed increases to a predetermined level above cranking speed but below idle speed, the transfer fuel pressure increases sufficiently to actuate the piston 98 outwardly against the bias of the return spring 106 to its outward limit position in engagement with the limit pin 102 where the piston 98 remains until after the engine is shut down. The ball check valve 114 prevents inward displacement of the piston 98 due to the intermittent outward force on the limit arms 84 by the roller shoes 58. Also, the check valve spring 112 is a low force spring which permits the ball check valve 114 to open to deliver transfer fuel pressure to the piston bore 100 at a speed below the predetermined level at which the piston is hydraulically actuated to its outer limit. Fuel leakage past the control piston 98 will allow the piston to move to its inward radial limit position under the bias of the return spring 106 when the engine stops.

When the piston 98 is actuated to its outer radial limit position, the limit arms 84 are pivoted about the hemispherical pivot seats 87 to reduce the intake stroke limit of the plungers 38. As shown, the limit arms 84 may be formed as leaf springs to deflect slightly outwardly by the impact force from the plungers 38, rollers 56, and shoes 58, and the inlet fuel pressure on the plungers 38. Due to increasing centrifugal force, the leaf springs 84 will be deflected outwardly an increasing amount with increasing speed to gradually increase the intake stroke limit as speed increases. Increasing the maximum intake stroke with speed is typically necessary for maintaining a relatively constant maximum available fuel charge because of the usual operating characteristics of fuel injection systems. Thus, the resiliency of the leaf spring limit arms 84 is established to provide the desired gradually increasing plunger stroke limit with increasing speed to provide a substantially constant maximum fuel charge.

The maximum available fuel chaarge is preferably established to achieve the maximum torque available with substantially complete air utilization and to avoid excess fuel which is incompletely burned and which, thereby, produces undesirable exhaust plolutants.

It has been found that although the stroke limit mechanism 80 can be designed to properly schedule the maximum plunger stroke for the entire operating speed range of an engine, ordinary wear of the limit mechanism parts will increase the maximum plunger stroke and resulting fuel delivery beyond acceptable limits. Such wear occurs at the ends 88 and 115 of the limit arms 84 and the cooperating edges of the plunger shoes 58 and piston 98 and also at the cooperating limit arm sockets 89 and mounting screw seats 87.

In accordance with the present invention and as a result of the recognition of the wear problem and wear caused increase in the plunger stroke limit, the limit arms 84 are provided with a suitable wear inhibiting coating to substantially reduce their wear. For example, it has been found that a 0.0005 inch porous electroless plating of nickel alloy and polymer particles (such as that provided by Poly-Plating, Inc. of Springfield, Mass. under the name Poly-Ond) provides substantially improved lubricity and hardness and, as a result, a substantially reduced rate of wear of the limit arm mechanism (i.e. the contacting surfaces of the limit arms 84 and the pivot seat 87, shoes 58 and piston 98).

Also, in accordance with the present invention, a wear compensating pin 102 is employed having a wear rate designed to generally match and generally compensate for the wear rate of the limit arm mechanism. In that regard, it can be seen upon reference to FIGS. 2 and 5, that wear of the limit pin 102 at its inner line of contact with piston 90 in openings 104 shifts the outward limit position of the actuating piston 98 outwardly to shift the plunger stroke limit inwardly to reduce the maximum available fuel charge. Although limit pin wear at its opposite engagement with piston 98 increases the available fuel charge during engine starting, there is a substantially lower rate of pin wear along its outer axial edge due to the very short time interval involved and in any event this increase in fuel delivery is generally not objectionable.

Figure 3:
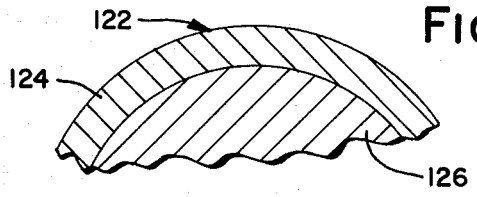
FIG. 3 is an enlarged fragmentary transverse section view, partly broken away, of an embodiment of a wear pin adapted to be employed in the stroke limit mechanism.

In the past, the limit pin was made for example of a hard relatively high carbon steel to have a very low rate of wear. Now, in accordance with the present invention, the wear pin 102 is made to have a generally predetermined rate of wear. The wear pin 102 can be made as a solid pin as shown in FIG. 2, or as generally shown in FIG. 3, a layer pin 122 can be provided having an outer relatively soft metal layer 124 for example of plated copper providing a first relatively high rate of wear and an inner relatively hard core 126 for example of steel providing a lower rate of wear. This is appropriate since the rate of wear of arms 84 and their engaging parts tends to be initially high but decreases with operating time. Depending on the thickness and wear rate of the outer metal layer 124 and the desired wear rate of the inner core 126, the core 126 is made to have a Rockwell C hardness of between 55 to 60 to provide a relatively low rate of wear compensation for example after a relatively thick copper layer of 0.001 to 0.002 inch has worn away. In contrast, with a relatively thin copper layer less than for example 0.001 inch, or where a copper layer is not provided a relatively soft core material is employed of for example 1020 or 1120 steel having a Rockwell C hardness of about 30 or less.

It has been found that a solid compensating wear pin 102 or a layered compensating wear pin 122 can be designed to at least generally compensate for the limit arm mechanism wear during an accelerated life test of the pump (i.e. 500 hours or more of full load engine operation during which the inlet metering valve 32 is fully opened and the limit mechanism 80 is effective to establish the fuel rate) and such that adjustment of the limit arm mounting screws 86 would not be required for up to the entire normal operating life of a fuel injection pump for example in automobile engine applications.

Also, it has been found that the rate of wear of the limit arms 84 and associated parts is substantially greater during an initial break-in period of the fuel injection pump and, whereby, a copper layer 124 of for example about 0.00065 inch thick provides a relatively high rate of wear compensation during the initial break-in period and the remaining pin core 126 can be made to provide a lower rate of wear compensation which closely matches the reduced rate of wear of the lever arm mechanism after the break-in period.

Figure 4:
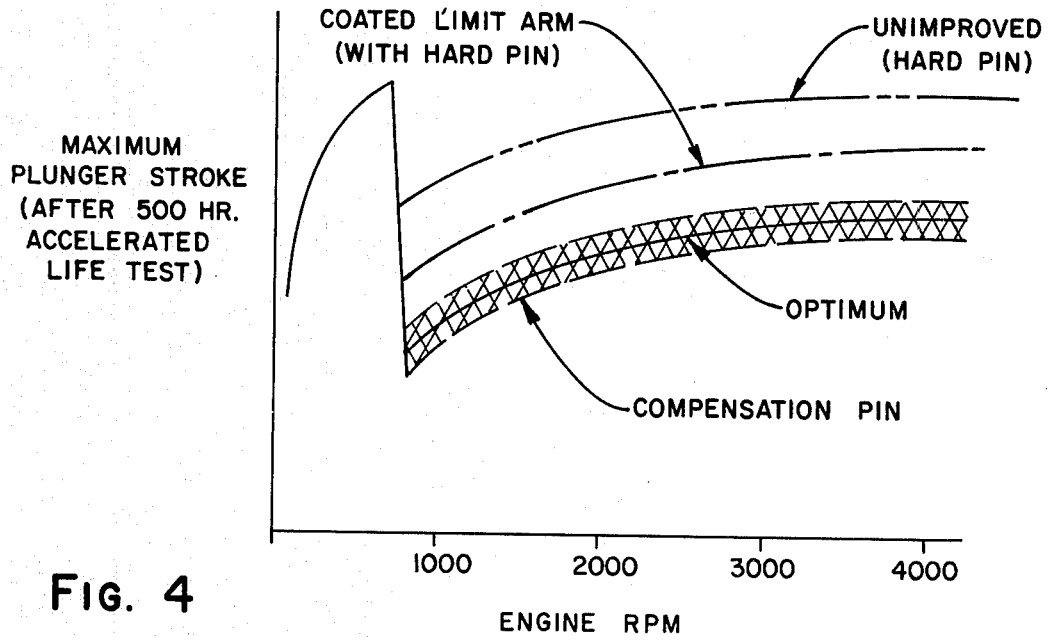
FIG. 4 is a graph comparing an optimum maximum plunger stroke curve with maximum plunger stroke curves provided by certain different stroke limit mechanisms after accelerated life tests thereof.

Referring to the graph of FIG. 4, a curve designated "Optimum" represents a predetermined optimum or designed plunger stroke limit provided by the stroke limit mechanism over the normal speed operating range of an associated engine. A relatively long available plunger stroke is shown at very low engine cranking speed to provide a large fuel charge for starting and is established when the piston 98 is actuated inwardly to its inner limit by the compression spring 106. A curve designated "Unimproved" represents the plunger stroke limit of a conventional unimproved stroke limit mechanism after an accelerated life test of 500 hours of full load engine operation at 3,600 RPM and represents an unacceptable increase in the stroke limit from the "Optimum" curve of about 0.006 inch due to normal stroke limit mechanism wear. A curve designated "Coated Limit Arm" represents the plunger stroke limit after the described 500 hour accelerated life test using limit arms 84 having the described porous nickel alloy and polymer coating. In the "Coated Limit Arm" curve, the increase in the plunger stroke from the "Optimum" curve of about 0.003 is about one-half the increase shown by the "Unimproved" curve (due to the reduced rate of wear provided by the limit arm coating) but is still at an unacceptable level.

A cross-hatched area curve designated "Compensation Pin" shows a plunger stroke limit range within which the actual stroke limit curve can be held after the described 500 hour accelerated life test when an appropriate compensating pin 102 or 122 is employed having a wear rate which closely matches the wear rate of the lever arm mechanism, and either employing or not employing the described surface coated limit arms 84. For example, using uncoated limit arms and a layered compensating pin 122 having a 0.002 inch copper layer on a pin core having a Rockwell C hardness between 55 to 60, the stroke limit variation from the "Optimum" curve can be hald within an acceptable tolerance. Also, where the limit arms 84 are coated as described and for example a solid wear pin 102 having a Rockwell C hardness of about 30 or less is provided having the appropriate wear rate, it has been found that the wear compensation provided by the wear pin 102 exactly matches the wear of the limit arm mechanism after the described 500 hour accelerated life test. Using coated limit arms 84 and a copper plated pin 122 having a copper thickness of 0.0065 inch and a steel core with a Rockwell C hardness of about 30 or less, the plunger stroke decreased 0.001 inch after the described 500 hour accelerated life test.

Thus, for each limit mechanism design, an appropriate pin 102 or 122 can be selected so that a "Compensation Pin" curve is provided which closely matches the "Optimum" curve.

Figure 5:
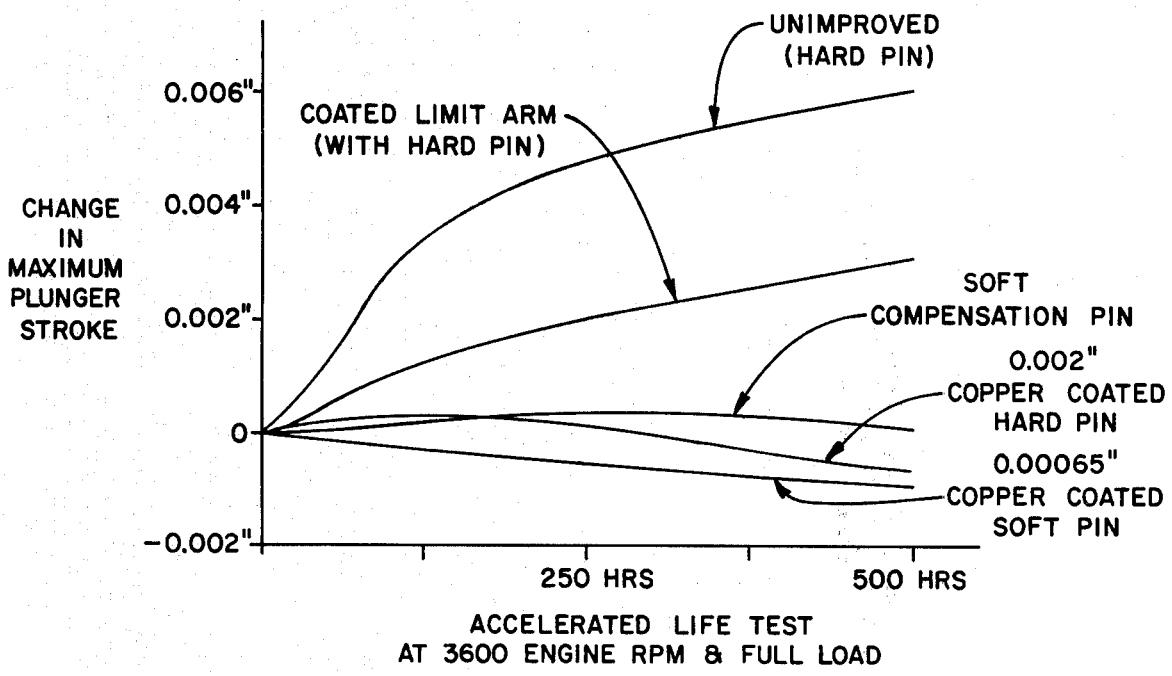
FIG. 5 is a graph comparing the changes during an accelerated life test in the maximum plunger strokes provided by certain different stroke limit mechanisms.
Figure 6:
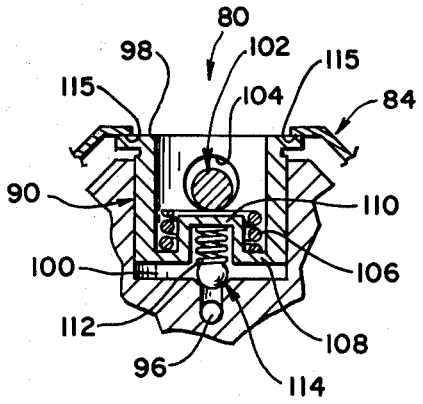
FIG. 6 is an enlarged fragmentary transverse section view, partly broken away and partly in section, showing an actuator piston of the stroke limit mechanism in its outer limit position.

A graph shown in FIG. 5 illustrates the change in the plunger stroke limit due to wear during an accelerated life test of 500 hours of full load engine operation at 3600 RPM using "Unimproved" and "Coated Limit Arm" curves corresponding to the curves of the same description shown in FIG. 4. In addition, there are illustrated (a) a curve designated "Soft Compensation Pin" showing the stroke limit compensation provided by a soft 1020 or 1120 steel pin having a Rockwell C hardness of about 30 with coated limit arms 84, (b) a curve designated "0.002 inch Copper Coated Hard Pin" showing the stroke compensation provided by a compensating pin having a 0.002 inch copper coating over a steel core having a Rockwell C hardness of between 55 and 60 with a conventional uncoated limit arm; and (c) a "0.00065 inch Copper Coated Soft Pin" showing the stroke compensation provided by a compensating pin having a 0.00065 inch copper coating over a steel core having a Rockwell C hardness of about 30 using coated limit arms 84.

The stroke compensation provided by the wear pin 102 or 122 ideally exactly matches the stroke limit increase caused by wear of the limit arm mechanism, and in any event, generally closely matches the wear increase so that the plunger stroke does not deviate from the optimum by an unacceptable amount and preferably less than about 0.001 inch.

The thickness of the copper layer can be selected in accordance with the degree of compensation desired. A pin 122 with a copper layer of for example 0.0005 inch provides for increased pin wear matching the greater rate of limit arm mechanism wear having a conventional uncoated limit arm during the break-in period only. A lower rate of pin wear provided by a soft 1020 or 1120 steel core 126 would then closely match the lower rate of limit arm mechanism wear after the pump break-in period. Also, a thicker layer of copper could be employed to overcompensate for the wear of the limit arm mechanism (which has either coated or uncoated limit arms) after the pump break-in period to ensure that the stroke compensation is generally at least equal to the stroke increase due to wear during a substantial pump operating period.

The compensating pin could be made of other materials or could have two or more different material layers to provide appropriate wear compensation with the wear pin over the useful life of the fuel injection pump. Also, although only circular wear pins 102 and 122 are shown, the wear pin could be designed to have a cross section wear profile, for example an oval profile with its long dimension parallel to the axis of the piston 98, to provide a stroke compensation curve closely matching the stroke limit increase due to wear. It is also contemplated that the piston opening 104 could be profiled or a suitable compensating wear insert (not shown) could be provided on the piston for engagement with the limit pin to assist in compensating for the plunger stroke limit increase due to limit arm mechanism wear.

Thus, in accordance with the present invention, the maximum fuel charge delivered by the pump at any speed and during the normal operating life of an associated engine can be held within an acceptable variation from the optimum. Also, for example to comply with stringent environmental requirements, the maximum plunger stroke can be held at or below the optimum stroke during substantially the entire useful operating life of the associated engine.

As will be apparent to persons skilled in the art, various modifications, adaptations and variations of the foregoing specific disclosure can be made without departing from the teachings of the present invention.

I claim:

1. In a fuel injection pump for an internal combustion engine having a charge pump with linear pumping means, actuating means for periodically actuating the pumping means in one linear direction thereof in synchronism with an associated internal combustion engine for periodically delivering pulses of pressurized fuel for injection of fuel charges into the internal combustion engine, and a stroke limit mechanism for variably setting a limit for the pumping means in the opposite intake stroke direction thereof for setting a fuel charge limit, the stroke limit mechanism comprising an operator shiftable in opposite pumping stroke increase and pumping stroke decrease directions thereof mechanical means connected to the operator and providing a limit stop for setting the intake stroke limit of the pumping means in accordance with the position of said operator, and operator abutment means including first fixed abutment means and second abutment means on the operator engageable therewith to set a limit for said operator in at least its said decrease direction to set a predetermined minimum stroke limit for the linear pumping means, the improvement wherein the first and second abutment means comprise wear compensation means adapted to wear at a predetermined rate to extend the operator limit in its said decrease direction to generally match the wear of said mechanical means and generally maintain the said predetermined minimum stroke limit setting of the linear pumping means.

2. A fuel injection pump according to claim 1 wherein the mechanical means comprises a pivotal limit arm pivoted by the operator and having the said limit stop on one end thereof for setting the intake stroke limit of the pumping means in accordance with the position of the operator, the pivotal limit arm having a coating of a porous nickel alloy and polymer for increased lubricity and wearability.

3. A fuel injection pump acccording to claim 1 or 2 wherein the first and second abutment means provide wear compensation means to generally maintain the said predetermined minimum stroke limit setting of the linear pumping means within a stroke increase tolerance of about 0.001 inch.

4. A fuel injection pump according to claim 1 or 2 wherein the first fixed abutment means is a solid wear compensating pin having a Rockwell C hardness of about 30.

5. A fuel injection pump according to claim 1 or 2 wherein the first fixed abutment means is a wear compensating pin having a relatively hard core and a relatively soft wear compensating layer on the core.

6. A fuel injection pump according to claim 5 wherein the layer is a copper layer no greater than 0.002 inch thick.

7. A fuel injection pump according to claim 5 wherein the core has a Rockwell C hardness between about 55 to 60.

8. A fuel injection pump according to claim 5 wherein the layer is a copper layer less than 0.001 inch thick.

9. A fuel injection pump according to claim 5 wherein the core has a Rockwell C hardness of about 30.

* * * * *